US005382375A

United States Patent [19]

You et al.

[11] Patent Number: 5,382,375

[45] Date of Patent: Jan. 17, 1995

[54] LOW POLLUTION POWDER DETERGENT COMPOSITION CONTAINING FATTY ACID ESTER

[75] Inventors: Seong-Soo You, Seoul; Hyun-Soo Kim, Kyounggido, both of Rep. of Korea

[73] Assignee: Mukunghwa Fats & Oils Co., Ltd., Seoul, Rep. of Korea

[21] Appl. No.: 799,485

[22] Filed: Nov. 27, 1991

[30] Foreign Application Priority Data

Jul. 1, 1991 [KR] Rep. of Korea ..... 11133/1991

[51] Int. Cl.[6] ..... C11D 9/30; C11D 9/22

[52] U.S. Cl. ..... 252/117; 252/132; 252/548; 252/174.14; 252/174.21

[58] Field of Search ..... 252/117, 132, 548, 174.14, 252/174.21

[56] References Cited

U.S. PATENT DOCUMENTS

| | | | |
|---|---|---|---|
| 3,920,586 | 11/1975 | Bonaparte et al. | 252/DIG. 1 |
| 3,926,830 | 12/1975 | Horiguchi et al. | 252/174.24 |
| 4,146,499 | 3/1979 | Rosano | 252/186.32 |
| 4,416,809 | 11/1983 | Magari et al. | 252/174.18 |
| 4,478,734 | 10/1984 | Ogina et al. | 252/527 |
| 4,842,766 | 6/1989 | Blehm et al. | 252/309 |
| 5,000,870 | 3/1991 | Shimizu | 252/548 |

*Primary Examiner*—Helen M. S. Sneed
*Assistant Examiner*—Nhat D. Phan
*Attorney, Agent, or Firm*—Lowe, Price, LeBlanc & Becker

[57] ABSTRACT

The present invention relates to a low pollution powder detergent composition containing ester of fatty acid intended for decreasing environmental pollution, which is made from polyoxyethylene fatty acid ester, ordinary soap, monoethanol amide of coconut fatty acid, diethanol amide of coconut fatty acid or a mixture of these ethanol amides of coconut fatty acid along with sodium carbonate added to as a packing material for powderization.

6 Claims, No Drawings

LOW POLLUTION POWDER DETERGENT COMPOSITION CONTAINING FATTY ACID ESTER

FIELD OF ART

The present invention relates to a low pollution powder detergent composition which prevents various types of environmental pollution arising from the use of conventional synthetic detergent in powder form for washing clothes, and is convenient for practical use.

BACKGROUND ART

Amidst daily aggravating environmental pollution, the impact of household sewage on contamination of water resources has now become a serious social problem. The environmental pollution caused by various types of synthetic detergents in use in the laundering of clothes has been analyzed to find:

1) that they increase BOD (biological oxygen demand) of the water of rivers and streams because of their low biodegradability;

2) that they give rise to lots of foam on the surface of rivers and streams through their propensity to cause air foam even at low concentration, whereupon the foam hinders oxygen in the atmosphere from dissolving into the water by blocking the passage of the sun's rays, resulting in a decrease of the amount of the oxygen dissolved in the water, and leads to the decay of the water;

3) and that they cause destruction of nature by doing harm to ecological system (aquatic life) due to their strong toxicity.

Now, the problem of water contamination is aggravated by the increase in household sewage due to the increase in population, and in order to solve this problem it is desirable to use natural detergents like soap that has high biodegradability, low effervescence, and low toxicity. However, natural detergents, inferior to synthetic detergents in their cleaning capability and inconvenience in use, can hardly satisfy housewives used to synthetic detergents. Hence a demand for production of a low pollution powder detergent having high detergency and convenience in use.

The present inventors have continued their study with the view of the development of a low pollution powder detergent which can reduce water contamination and provide a detergency and convenience equal to or better than the existing synthetic detergents. As a result, the inventors have discovered that a composition of fatty acid ester, soap, soda ash, and fatty acid amide in a certain ratio, plus certain inorganic materials added thereto, can achieve the objectives given above. On the basis of this discovery, the present invention has been completed.

DESCRIPTION

The objective of the present invention is to provide a low pollution powder detergent composition characterized by the following as its essential components:

1) polyoxyethylene fatty acid ester given in the general formula $RCOO[CH_2CH_2O]nH$ by 0.1 wt % to 20 wt %;

2) soap (sodium salt of fatty acid and potassium salt of fatty acid) having fatty acid residue with 12 to 20 carbon numbers by 0.1 wt % to 6 wt %;

3) fatty acid monoethanol amide, given in the general formula $RCONHCH_2CH_2OH$, fatty acid diethanol amide given in the general formula $RCON[CH_2CH_2OH]_2$, or mixtures of these, by 0.1 wt % to 10 wt %, and;

4) sodium carbonate, as a packing material, by 20 wt % to 50 wt %.

For production of a powder detergent to meet such purposes, the arts are already known about production of powder detergents of good biodegradability by powderizing soap through addition of a powderizer or by composing powderizers like such a known non-ionic surfactant as fatty acid diethanol amide or soda ash, but in these cases, the detergency is hardly satisfactory because it mainly relies upon the soap's own, and an encrustation is often brought about.

After assiduous research and experiments to overcome these demerits and shortcomings, the inventors have developed a novel composition of a powder detergent which is easily biodegraded, even in the water of a stream or a river, in a short time, not only reducing bad effects on the ecological system even before biodegradation but also being convenient for formation of powder and keeping its stability as powder. The present invention is a low pollution powder composition detergent which contains fatty acid ester as its main component which is a non-ionic surfactant of high detergency with fatty acid monoethanol amide or fatty acid diethanol amide and soap added in suitable proportions along with sodium carbonate as a packing material for powderization.

The fatty acid ester here in particular is polyoxyethylene fatty acid ester given in the general formula $RCOO[CH_2CH_2O)nH$ with its best detergency displayed when the degree of polymerization of ethylene oxide is at 5–25 mol, more preferably at 7–15 mol.

A further detailed description of each component in the present invention follows:

In the present invention it was determined that, among the polyoxyethylene fatty acid esters given in the general formula $RCOO[CH_2CH_2O]nH$, used as the fatty acid ester component, such mixed fatty acids which have fatty acid residue of 14–18 carbon numbers and its titer (the solidification point of fatty acids) being 20° C. to 40° C. are economically much superior to such refined fatty acids as lauric acid or myristic acid.

The polyoxyethylene fatty acid ester is obtained from natural fats and oils of 12–20 carbon numbers by treatment with a high pressure degrader and a distiller; after that, by esterification with ethylene oxide in the presence of alkali catalysts, and then at this stage the degree of polymerization of ethylene oxide is made at 5–25 mol by controlling the quantity of ethylene oxide.

In the composition of the present invention its content of polyoxyethylene fatty acid ester is more than 0.1 wt % and less than 20 wt %, and preferably 10–20 wt %. In case the content is less than 0.1 wt %, the removal effect of fat contamination is not sufficient, and in case it exceeds 20 wt %, the powder of the final product is found to be sticky, causing frequent so-called caking.

The soap used in the present invention is simple ordinary soap, a sodium or a potassium salt with a fatty acid residue of 12 to 20 carbon numbers, and even more preferably, 14 to 18 carbon numbers is found to be the best of all. In view of the production process of a powder detergent, the soap in liquid form is preferable to that in solid form, the former being better for handling, spreading and dissolving faster. As to the liquid soap, a 35% thick solution of fatty acid potassium soap with polyethylene glycol added thereto, was used.

The soap content of the composition of the present invention is 0.1~6 wt %, and preferably in the range of 2~5 wt % in dry weight. When the soap content is under 0.1 wt % the removal effects on inorganic contamination due to the repulsion between the textiles and the contamination by surface electricity are not sufficient, while, if the content is over 6 wt %, the viscosity of the slurry rises sharply, making desiccation of the powder difficult.

Although the fatty acid amides, namely monoethanol amide of coconut fatty acid given in the general formula $RCONHCH_2CH_2OH$, diethanol amide of coconut fatty acid given in the general formula $RCON[CH_2CH_2OH]_2$, and mixture thereof may be used, monoethanol amide of palm fatty acid is the more preferable because of its high melting point and facility to powderize.

This fatty acid amide can be obtained by the 1:1 condensation reaction of higher fatty acid such as coconut fatty acid with monoethanol amine or diethanol amine.

The fatty acid amide content of the composition of the present invention is 0.1 wt % to 10 wt %, more preferably 3–7 wt %. When this content is less than 0.1 wt %, the desirable dispersibility of the soda-ash soap can hardly be expected, and from the soap components sediments of soda-ash soap are formed to lower the detergency in hard water, taking a longer time to clean, and the encrusting sediments cause a change of color in the laundry.

Furthermore, if the content is more than 10 weight %, the dispersibility of the soda-ash soap does not rise any higher even if a greater quantity of the fatty acid amide is used, and the powder of the final product is undesirable viscous.

As for the sodium carbonate, there is the lighter ash with apparent specific gravity of less than 1 and the heavier ash with apparent specific gravity of over 1. The lighter ash customarily used in production of detergent compositions is better than the other, and as to its content, there is no specific limitation but 20–50 wt % is usually adopted.

Besides the essential components mentioned above, other elements used in the production of conventional detergents can be added to the composition of the present invention. For instance, inorganic preparations like sodium sulfate and sodium silicate, hard water softening agents like acryl polymer and zeolite, fluorescent bleacher, enzyme, flavors, etc. can also be added.

Considering the objective of the present invention, namely a low pollution detergent powder, various types of conventional surfactants such as anionic surfactants like alkylbenzene sodium sulfonate, alkyl sodium sulfate, α-olefine sodium sulfonate, polyoxyethylene alkyl ether sodium sulfate, etc., non-ionic surfactants like polyoxyethylene alkyl ether, polyoxyethylene alkyl phenol, etc., and cationic surfactants like quaternary ammonium salts are to be avoided if possible because these are badly toxic and feared to do harm to living organisms in water.

A few examples are given below for illustration of the present invention, but the idea and concept of the present invention can hardly be confined to this limited number of examples alone.

| Components | Weight % |
|---|---|
| **Example 1** | |
| Polyoxyethylene fatty acid ester (polymerization degree of ethylene oxide: 5–25 mol) | 15 |
| Soap (fatty acid with 14–18 carbon numbers) | 3 |
| Monoethanol amide of coconut fatty acid | 5 |
| Sodium carbonate | 50 |
| Sodium sulfate | 12 |
| Sodium silicate | 5 |
| Hard water softener | 10 |
| Fluorescent bleacher | small amount |
| Flavor | small amount |
| Enzyme | small amount |
| **Example 2** | |
| Polyoxyethylene fatty acid ester (polymerization degree of ethylene oxide: 7–15 mol) | 15 |
| Soap (fatty acid with 14–18 carbon numbers) | 5 |
| Monoethanol amide of coconut fatty acid | 5 |
| Sodium carbonate | 50 |
| Sodium sulfate | 10 |
| Sodium silicate | 5 |
| Hard water softener | 10 |
| Fluorescent bleacher | small amount |
| Flavor | small amount |
| Enzyme | small amount |
| **Example 3** | |
| Polyoxyethylene fatty acid ester (polymerization degree of ethylene oxide: 7–15 mol) | 18 |
| Soap (fatty acid with 14–18 carbon numbers) | 4 |
| Diethanol amide of coconut fatty acid | 5 |
| Sodium carbonate | 50 |
| Sodium sulfate | 8 |
| Sodium silicate | 5 |
| Hard water softener | 10 |
| Fluorescent bleacher | small amount |
| Flavor | small amount |
| Enzyme | small amount |
| **Example 4** | |
| Polyoxyethylene fatty acid ester (polymerization degree of ethylene oxide: 7–15 mol) | 20 |
| Soap (fatty acid with 14–18 carbon numbers) | 3 |
| Monoethanol amide of coconut fatty acid: Diethanol amide of coconut fatty acid (9:1 mixture) | 5 |
| Sodium carbonate | 50 |
| Sodium sulfate | 7 |
| Sodium silicate | 5 |
| Hard water softener | 10 |
| Fluorescent bleacher | small amount |
| Flavor | small amount |
| Enzyme | small amount |
| **Example 5** | |
| Polyoxyethylene fatty acid ester (polymerization degree of ethylene oxide: 7–15 mol) | 15 |
| Soap (fatty acid with 12–20 carbon numbers) | 3 |
| Monoethanol amide of coconut fatty acid | 5 |
| Sodium carbonate | 50 |
| Sodium sulfate | 12 |
| Sodium silicate | 5 |
| Hard water softener | 10 |
| Fluorescent bleacher | small amount |
| Flavor | small amount |
| Enzyme | small amount |

The effects of the low pollution powder detergent of the present invention, i.e., its biodegradability, foaming capability, detergency, and ecological effects have been compared with those of conventional powder detergents.

1. Biodegradability

Adopting activated sludge as the source of biodegradable living organisms in accordance with the Korean standard KS M 2714, the activated sludge was shake-cultured in detergents to test its biodegradability to obtain such results as given in Table 1.

For a period of seven to eight days, there was practically no difference in biodegradation between the detergent of the present invention and conventional detergent of LAS (alkylbenzen sulfonate) type, but for a shorter single-day period the biodegradability of the detergent of the present invention stood much higher at 98%, compared with conventional LAS type detergents' 65% to 88%.

2. Foaming Capability

According to the Korean standard KS M 2709 for testing foam and its stability, 0.1% (the standard content of conventional detergents in normal use) water solution was prepared, and into 50 ml of it, 200 ml of the same water solution was dropped from a height of 90 cm for 30 seconds to measure the foam created. The figures are given in Table 2.

As seen in Table 2, the foaming capability of the present invention was 20, which was very low, compared with the 100–180 of conventional detergents.

3. Ecological Effect (A) Experiment on gold fish

Since there is no international standard method for ecological tests, simple experiments were performed as follows; with 1200 gold fish by using the composition of the present invention and various conventional detergents, including laundry soap at 100 ppm, 200 ppm, and 300 ppm respectively.

i) 2 of water was poured into tanks of 3 capacity;

ii) An amount of each detergent according to the corresponding concentration was added with an allowable error up to 0.1 mg to the water of different tanks;

iii) The water of each tank was stirred by a joint stirrer;

iv) Three gold fish of a similar size (each weighing approximately 25 g) were put in each tank;

v) Air was blown into each tank;

vi) Conditions of the gold fish were observed at an interval of 10 minutes, and checking up the time of the death of three gold fish each in a tank on an average, the average life span of each group of gold fish was calculated.

The results are shown in Table 3.

(B) Comparison of TLm values (concentration of chemicals to kill more than half of underwater life) by use of minnows.

By using minnows that belong to the smaller category among fish living in streams, the TLm values toxicity as to each type of detergent were obtained in accordance with KS M 0111-86 and KS M 2709-85 methods. The results are given in Table 4.

As can be seen in Tables 3 and 4 the composition of the present invention is far superior to the existing conventional powder detergents in view of ecological safety.

4. Detergency

The detergency test was performed according to the KS M 2715 method, by the use of Terg-O-Tometer, with 0.1% water solution. The results are given in Table 5.

As seen in Table 5, the detergent of the present invention displayed a detergency equal to some of the existing conventional synthetic powder detergents that have better detergency than most others when these were used in soft water, and superior detergency in hard water.

TABLE 1

Biodegradability

| Type of detergent | Biodegradability (%) 7–8 days | 1 day |
|---|---|---|
| Present invention | 99 | 98 |
| Conventional LAS type | 97–98 | 65–88 |

TABLE 2

Foaming capability

| Type of detergent | Foaming capability |
|---|---|
| Present invention | 20 m/m |
| LAS type A | 170 m/m |
| LAS type B | 155 m/m |
| LAS type C | 175 m/m |
| Higher alcohol type | 100 m/m |
| AOS type | 140 m/m |
| α-fatty acid type | 150 m/m |
| Laundry soap (cake) | 180 m/m |

TABLE 3

Average life span of gold fish against each detergent

| Detergent | Detergent concentration a) 100 ppm | b) 200 ppm | c) 300 ppm |
|---|---|---|---|
| Present invention | alive | alive | 21h |
| LAS type A | 2h 13 min | 1h 30 min | 1h 23 min |
| LAS type B | 2h 20 min | 1h 23 min | 1h 23 min |
| AOS type | 2h 30 min | 2h 33 min | 1h 56 min |
| Higher alcohol type | 5h 13 min | 1h 53 min | 1h 30 min |
| α-fatty acid type | 1h 43 min | 1h 20 min | 1h 10 min |
| Laundry soap (cake) | alive | 20h 3 min | 3h 47 min |

**(a) test for 48 hours
(b) test for 24 hours
(c) test for 24 hours

TABLE 4 a) TLm (ppm) values of toxicity to minnows

| Detergent | a) TLm (ppm) |
|---|---|
| Present invention | 155 |
| α-fatty acid type | 17 |
| Laundry soap (cake) | 155 |
| Higher alcohol type | 26 |
| AOS type | 17 |

(a) TLm values after 24 hours

TABLE 5

Relative detergency in soft water and hard water respectively

| Detergent | a) Soft water | b) Hard water |
|---|---|---|
| Present invention | 96 | 100 |
| α-fatty acid type | 100 | 89 |
| Higher alcohol type | 94 | 83 |
| LAS type A | 96 | 87 |
| LAS type B | 87 | 75 |
| LAS type C | 81 | 74 |
| LAS type D | 82 | 76 |
| LAS type E | 75 | 72 |
| LAS type F | 76 | 70 |
| LAS type G | 75 | 75 |

TABLE 5-continued

| Detergent | Relative detergency in soft water and hard water respectively a) Soft water | b) Hard water |
|---|---|---|
| LAS type H | 54 | 56 |

**(a) temperature 20° C.; rate - 120 rpm; test cloth - EMPA116; concentration - 0.1% water solution; time - 30 minutes; water type - soft water
(b) temperature 20° C.; rate - 120 rpm; test cloth - EMPA111; concentration - 0.1% water solution; time - 10 minutes; water type - hard water (70 ppm)

We claim:

1. A powder detergent composition comprising a conventional fatty acid soap, a fatty acid alkanol amide, a builder for powderization, and polyoxyethylene fatty acid esters, characterized by (a) the polyoxyethylene fatty acid ester having the formula $R_1$ $COO[CH_2CH_2O]_nH$ wherein $R_1$ is an alkyl group having 12 through 20 carbon atoms and n is an integer of 5–25, (b) the fatty acid soap having the formula $R_2COOM$ wherein $R_2$ is an alkyl group having 12 through 20 carbon atoms and M is a salt-forming pair ions of alkali metals, (c) the fatty acid alkanol amide comprising fatty acid mono- and diethanol amides or mixtures thereof having the formulae, $R_3$ $CONHCH_2CH_2OH$ and $R_3'$ $CON[CH_2CH_2OH]_2$, respectively wherein both $R_3$ and $R_3'$ are alkyl groups having 12 through 20 carbon atoms, and (d) the builder comprising a sodium carbonate having an apparent specific gravity of one or less, wherein the polyoxyethylene fatty acid ester is between about 0.1 wt % and 20 wt % of said powder detergent composition.

2. The powder detergent composition in accordance with claim 1, wherein the fatty acid soap is between about 0.1 wt % and 6 wt % of said powder detergent composition.

3. The powder detergent composition in accordance with claim 1, wherein the fatty acid mono- and di- ethanol amides or mixtures thereof are between about 0.1 wt % and 10 wt % of said powder detergent composition.

4. The powder detergent composition in accordance with claim 1, wherein the pair ion of alkali metals include sodium and potassium.

5. The powder detergent composition in accordance with claim 1 wherein n is from 7 to 15, said powder detergent composition having improved biodegradability, reduced foaming capability, and improved detergency.

6. A powder detergent composition comprising a conventional fatty acid soap, a fatty acid alkanol amide, a builder for powderization, and polyoxyethylene fatty acid esters, characterized by (a) the polyoxyethylene fatty acid ester having the formula $R_1$ $COO[CH_2CH_2O]_nH$ wherein $R_1$ is an alkyl group having 12 through 20 carbon atoms and n is an integer of 5–25 , (b) the fatty acid soap having the formula $R_2COOM$ wherein $R_2$ is an alkyl group having 12 through 20 carbon atoms and M is a salt-forming pair ions of alkali metals, (c) the fatty acid alkanol amide comprising fatty acid mono- and diethanol amides or mixtures thereof having the formulae, $R_3$ $CONHCH_2CH_2OH$ and $R_3'$ $CON[CH_2CH_2OH]_2$, respectively wherein both $R_3$ and $R_3'$ are alkyl groups having 12 through 20 carbon atoms, and (d) the builder comprising a sodium carbonate having an apparent specific gravity of one or less, wherein the sodium carbonate is between 20 wt % and 50 wt % of said powder detergent composition, the polyoxyethylene fatty acid ester is between about 0.1 wt % and 20 wt % of said powder detergent composition, the fatty acid soap is between about 0.1 wt % and 6 wt % of said powder detergent composition, and the fatty acid mono- and diethanol amides or mixtures thereof are between about 0.1 wt % and 10 wt % of said powder detergent composition.

* * * * *